US007401616B2

(12) United States Patent
Wang

(10) Patent No.: US 7,401,616 B2
(45) Date of Patent: Jul. 22, 2008

(54) UMBRELLA WITH A FOLDABLE STEM

(75) Inventor: Max Wang, No. 19, Ta-Yuan 13th St., Tai-Ping (TW)

(73) Assignee: Max Wang, Tai-Ping (TW)

( * ) Notice: Subject to any disclaimer, the term of this patent is extended or adjusted under 35 U.S.C. 154(b) by 273 days.

(21) Appl. No.: 11/402,510

(22) Filed: Apr. 12, 2006

(65) Prior Publication Data

US 2007/0240745 A1 Oct. 18, 2007

(51) Int. Cl.
*A45B 25/06* (2006.01)
*A45B 25/08* (2006.01)

(52) U.S. Cl. ..... 135/28; 135/41; 135/40

(58) Field of Classification Search ..... 135/28, 135/37–41

See application file for complete search history.

(56) References Cited

U.S. PATENT DOCUMENTS 291,104 A * 1/1884 Stone ..... 135/37
868,071 A * 10/1907 Bosel ..... 135/28
5,297,571 A * 3/1994 Chu et al. ..... 135/24
5,515,878 A * 5/1996 Wu ..... 135/28
5,533,541 A * 7/1996 Cheng et al. ..... 135/22
5,964,235 A * 10/1999 Wang ..... 135/28
6,539,964 B1 * 4/2003 Ko ..... 135/28
6,941,960 B2 * 9/2005 Huang ..... 135/41
7,089,950 B2 * 8/2006 Lin et al. ..... 135/38
2002/0179130 A1 * 12/2002 Ko ..... 135/39
2003/0221714 A1 * 12/2003 Wang ..... 135/33.6

* cited by examiner

*Primary Examiner*—David R Dunn
*Assistant Examiner*—Tania Abraham
(74) *Attorney, Agent, or Firm*—Brinks Hofer Gilson & Lione

(57) ABSTRACT

An umbrella includes an elongated stem having telescopically connected inner and outer tubular segments, a top hub secured to the inner tubular segment to define an upper annular space therebetween, a tubular runner surrounding the stem, slidable between upper and lower positions to spread-out or collapse a canopy and rib assembly, and spaced apart from the inner tubular segment to define a lower annular space therebetween, a tubular spacer slidably sleeved on the inner tubular segment to be inserted into the lower annular space when the runner is displaced to the upper position so as to prevent wobbling movement of the runner, and movable by the outer tubular segment to be thereby withdrawn into the upper annular space when the outer tubular segment is displaced to the retracted position, and a biasing member disposed to bias the spacer into the lower annular space.

4 Claims, 5 Drawing Sheets

UMBRELLA WITH A FOLDABLE STEM

BACKGROUND OF THE INVENTION

1. Field of the Invention

This invention relates to an umbrella with a foldable stem, more particularly to an umbrella which includes a tubular spacer that is received in a tubular runner when the umbrella is stretched so as to prevent wobbling movement of the runner.

2. Description of the Related Art

Referring to FIG. 1, a conventional umbrella is shown to include an elongated stem 1, a top hub 2 secured on a top of the stem 1, a tubular runner 3 slidably mounted on the stem 1, and a canopy and rib assembly 4 connected to the top hub 2 and the runner 3. The stem 1 includes at least one outer tube 101 and at least one inner tube 102 which is telescopically fitted in the outer tube 101 so as to be extendable and retractable relative thereto.

Since the outer tube 101 and the inner tube 102 are employed to construct the stem 1, when the runner 3 is positioned on the inner tube 102 at an upper position to maintain the canopy and rib assembly 4 in a spread-out position, a gap (I) is present between an inner wall 301 of the runner 3 and the inner tube 102 to cause wobbling movement of the runner 3, thereby resulting in damage to the stem 1.

SUMMARY OF THE INVENTION

The object of the present invention is to provide an umbrella which can prevent wobbling movement of a runner thereof.

According to this invention, the umbrella includes an elongated stem elongated along a longitudinal axis, and including an outer tubular segment which has an upper annular end, and an inner tubular segment which is telescopically fitted in the outer tubular segment and which has an upper end portion that is distal from the outer tubular segment such that the upper annular end is movable relative to the inner tubular segment along the longitudinal axis between a retracted position and an extended position where the upper annular end is close to and remote from the upper end portion, respectively. A top hub has a hub surrounding wall including an upper hub portion which surrounds and which is secured to the upper end portion of the inner tubular segment, and a middle hub portion which extends from the upper hub portion downwardly and which is spaced apart from the inner tubular segment in radial directions relative to the longitudinal direction to define an upper annular space therebetween. A tubular runner has a runner surrounding wall that surrounds and that is slidable relative to the stem between upper and lower positions, which are respectively distal from and proximate to the top hub. The runner surrounding wall is configured to be spaced apart from the inner tubular segment in the radial directions so as to define a lower annular space therebetween. A canopy and rib assembly is mounted pivotally on the top hub, and is coupled to and is moved with the runner between spread-out and collapsed positions, which correspond to the upper and lower positions, respectively. A tubular spacer is slidably sleeved on the inner tubular segment, and is configured such that the tubular spacer is insertable into the lower annular space when the runner is displaced to the upper position so as to minimize the dimension of the lower annular space, thereby preventing wobbling movement of the runner relative to the stem, and such that the tubular spacer is movable by the upper annular end to be thereby withdrawn into the upper annular space when the upper annular end is displaced to the retracted position. A biasing member is disposed to bias the tubular spacer into the lower annular space.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
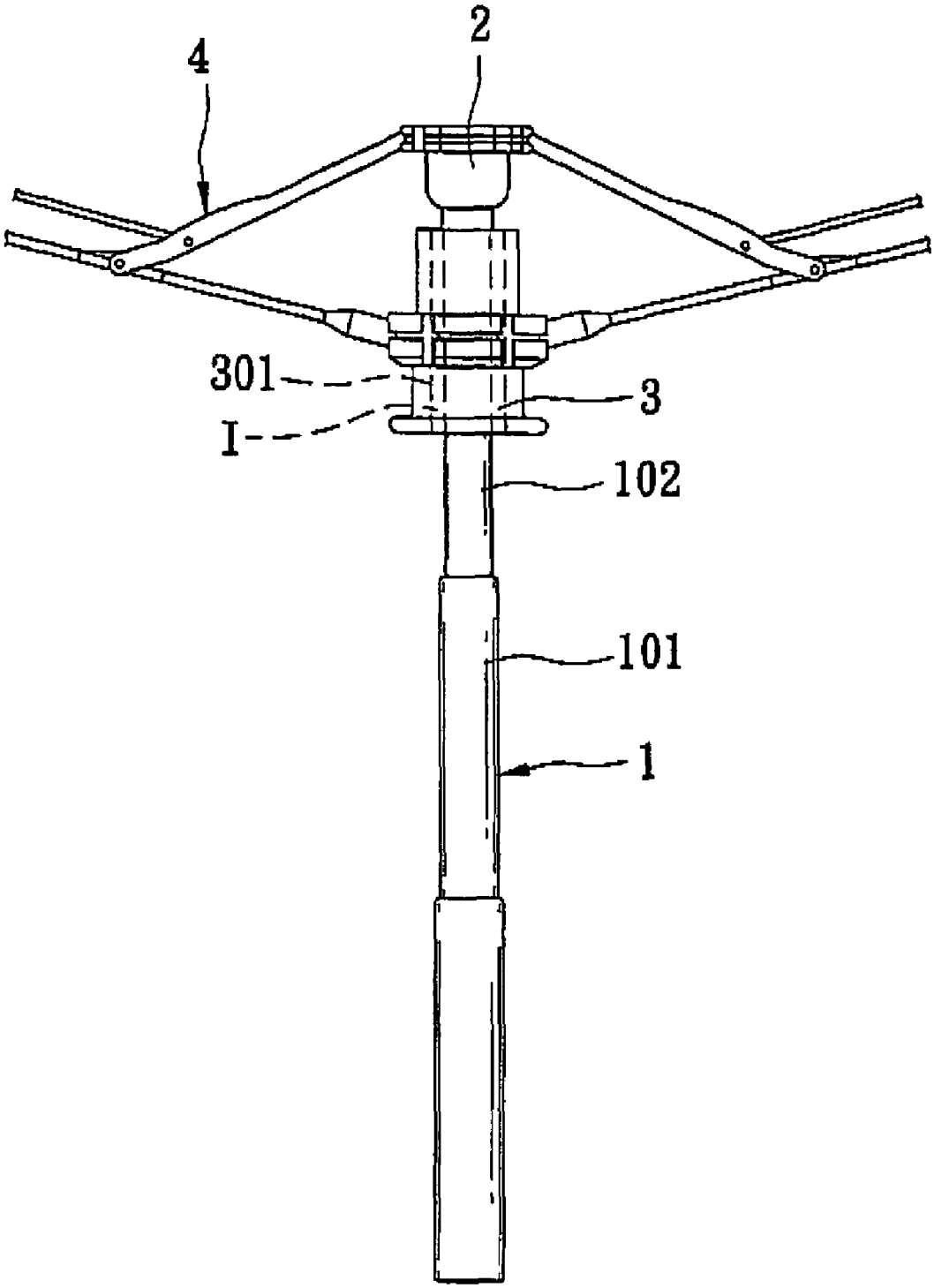
FIG. 1 PRIOR ART
FIG. 1 is a fragmentary schematic view of a conventional umbrella in a stretched state.

Before the present invention is described in greater detail, it should be noted that same reference numerals have been used to denote like elements throughout the specification.

Figure 2:
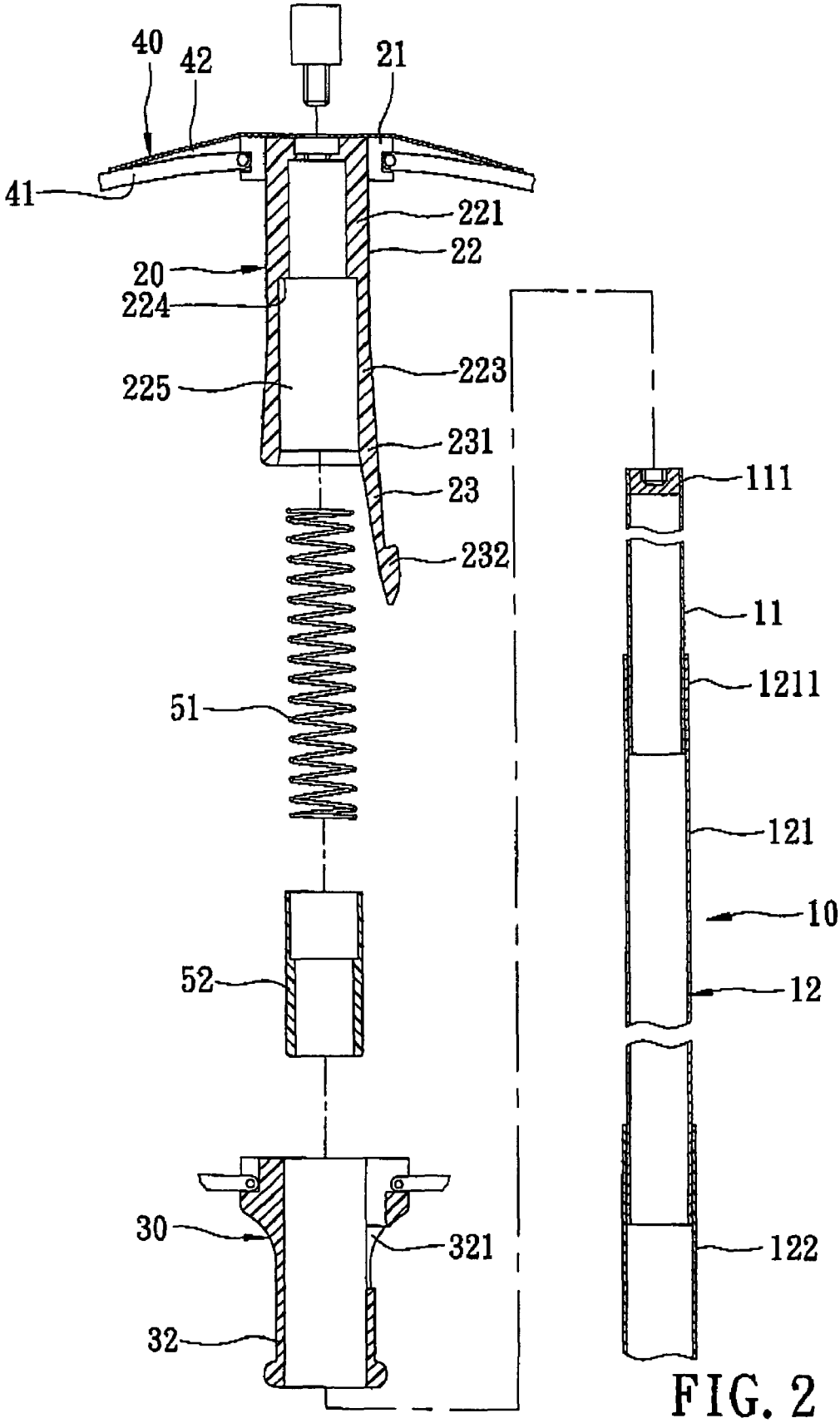
FIG. 2 is a fragmentary exploded sectional view of the first preferred embodiment of an umbrella according to this invention.
Figure 3:
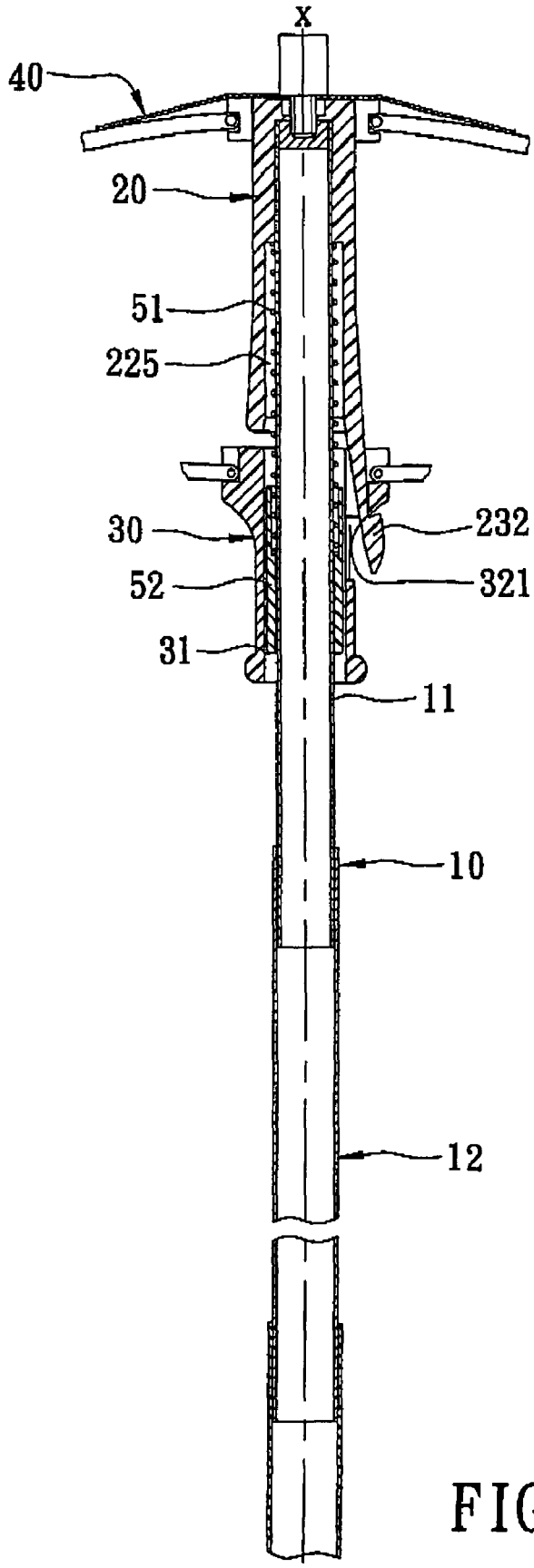
FIG. 3 is a fragmentary sectional view of the first preferred embodiment when stretched.
Figure 4:
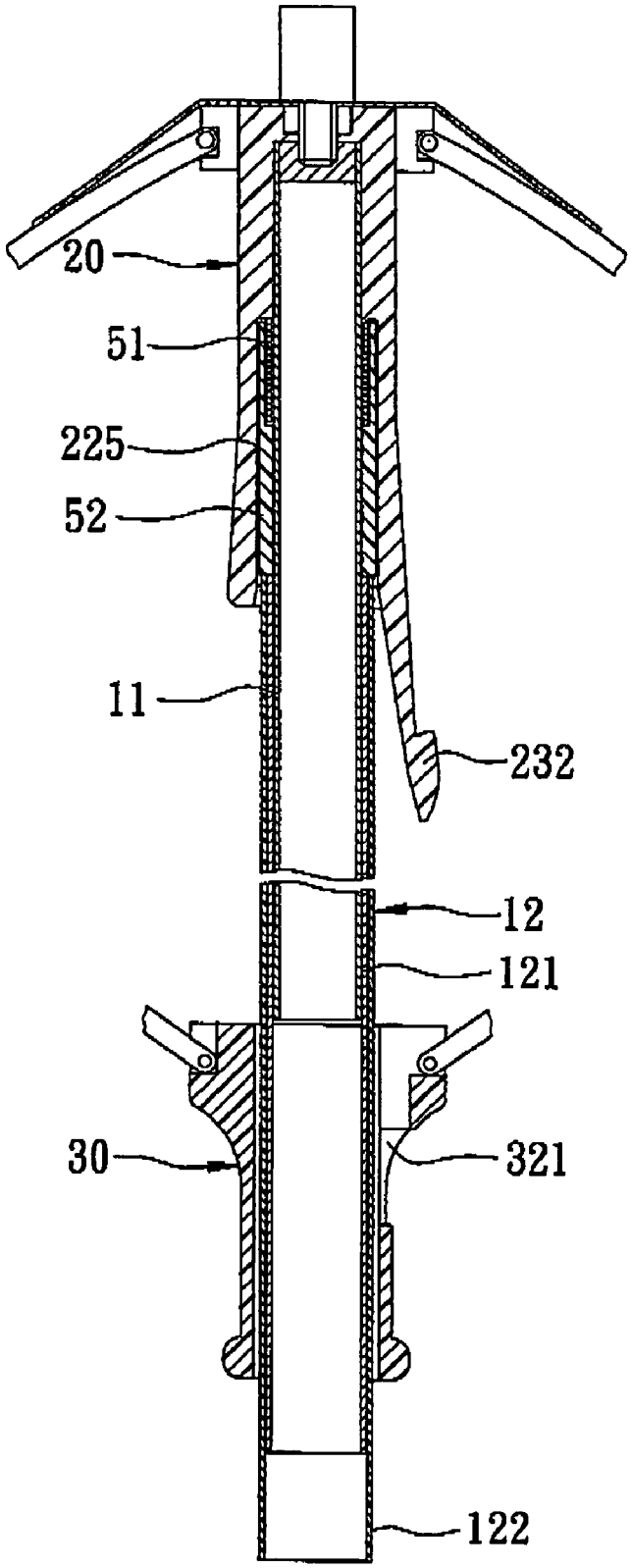
FIG. 4 is a fragmentary sectional view of the first preferred embodiment when folded.

Referring to FIGS. 2 to 4, the first preferred embodiment of an umbrella according to the present invention is shown to comprise an elongated stem 10, a top hub 20, a tubular runner 30, a canopy and rib assembly 40, a tubular spacer 52, and a biasing member 51.

The stem 10 is elongated along a longitudinal axis (X), and includes outer and inner tubular segments 12, 11. Preferably, the outer tubular segment 12 may include an outer tube 122 and an inner tube 121 which is telescopically fitted in the outer tube 122. The outer tubular segment 12 has an upper annular end 1211. The inner tubular segment 11 is telescopically fitted in the outer tubular segment 12, and has an upper end portion 111 which is distal from the outer tubular segment 12 such that the upper annular end 1211 is movable relative to the inner tubular segment 11 along the longitudinal axis (X) between a retracted position and an extended position where the upper annular end 1211 is close to and remote from the upper end portion 111, respectively.

The top hub 20 has a hub surrounding wall 22 including an upper hub portion 221 which surrounds and which is secured to the upper end portion 111 of the inner tubular segment 11, a middle hub portion 223 which extends from the upper hub portion 221 downwardly and which is spaced apart from the inner tubular segment 11 in radial directions relative to the longitudinal direction to define an upper annular space 225 therebetween, and a retaining portion 23 which has a fixed end 231 integrally connected to the middle hub portion 223, and a retaining end 232 extending downwardly from the fixed end 231 such that the retaining portion 23 acquires a biasing force that urges the retaining end 232 to move radially and outwardly. The middle hub portion 223 is configured to cooperate with the upper hub portion 221 to form an annular shoulder 224 which confronts the upper annular end 1211 along the longitudinal axis (X).

The runner 30 has a runner surrounding wall 32 that surrounds and that is slidable relative to the stem 10 between upper and lower positions, which are respectively proximate to and distal from the top hub 20. The runner surrounding wall 32 is configured to be spaced apart from the inner tubular segment 11 in the radial directions so as to define a lower annular space 31 therebetween. The runner surrounding wall 32 has a retaining hole 321 extending therethrough in a radial direction.

The canopy and rib assembly 40 includes a plurality of ribs 41 which are mounted pivotally on a ferrule portion 21 of the top hub 20, and which are coupled to and which are moved with the runner 30 between spread-out and collapsed positions, which correspond to the upper and lower positions, respectively, so as to spread-out or collapse a canopy 42.

The tubular spacer 52 is slidably sleeved on the inner tubular segment 11. The biasing member 51 is a coil spring which has two opposite ends abutting against the annular shoulder 224 and the tubular spacer 52, respectively, so as to bias the tubular spacer 52 downwardly.

When the runner 30 is moved to the upper position to stretch the canopy and rib assembly 40, as shown in FIG. 3, the retaining end 232 is retained in the retaining hole 321, and the tubular spacer 52 is inserted into the lower annular space 31 by means of the biasing member 51 so as to minimize the dimension of the lower annular space 31, thereby preventing wobbling movement of the runner 30 relative to the stem 10. When the runner 30 is moved to the lower position so that the retaining end 232 disengages from the retaining hole 321 for collapsing the canopy and rib assembly 40, as shown in FIG. 4, and when the outer tubular segment 12 is moved to the retracted position, the tubular spacer 52 is moved by the upper annular end 1211 of the outer tubular segment 12 to be thereby withdrawn into the upper annular space 225 against the biasing force of the biasing member 51.

Figure 5:
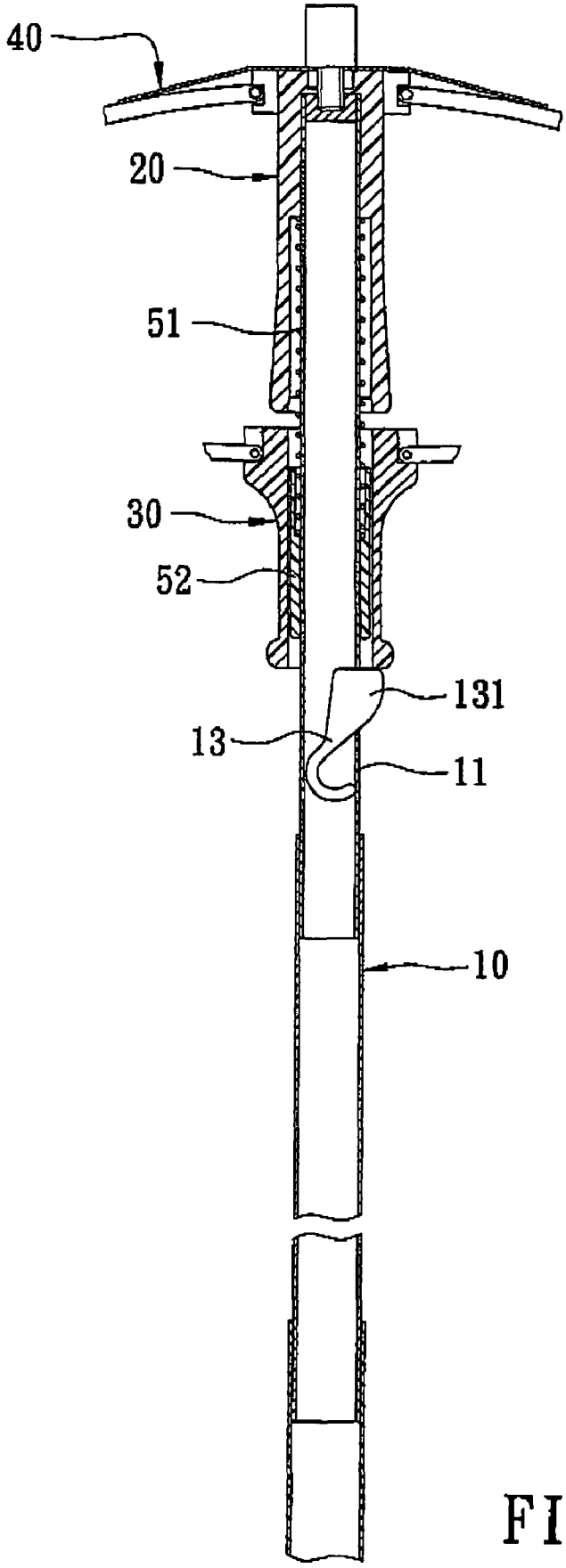
FIG. 5 is a fragmentary sectional view of the second preferred embodiment of an umbrella according to this invention.

Referring to FIG. 5, the second preferred embodiment of an umbrella according to this invention is shown to be similar to the previous embodiment in construction, except that instead of providing the retaining portion 23, a leaf spring 13 having a biasing force is disposed in the inner tubular segment 11. The leaf spring 13 has a retaining end 131 which extends radially and which is movable relative into the inner tubular segment 11 between a retracted position, where the retaining end 131 is depressed radially to retreat in the inner tubular segment 11 against the biasing force when the tubular runner 30 is displaced from the lower position to the upper position, and an extended position, where the retaining end 131 is disposed outwardly of the inner tubular segment 11 to hold the tubular runner 30 in place when the tubular runner 30 is in the upper position.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An umbrella comprising:

an elongated stem elongated along a longitudinal axis, and including an outer tubular segment which has an upper annular end, and an inner tubular segment which is telescopically fitted in said outer tubular segment and which has an upper end portion that is distal from said outer tubular segment such that said upper annular end is movable relative to said inner tubular segment along the longitudinal axis between a retracted position and an extended position where said upper annular end is close to and remote from said upper end portion, respectively;

a top hub having a hub surrounding wall including an upper hub portion which surrounds and which is secured to said upper end portion of said inner tubular segment, and a middle hub portion which extends from said upper hub portion downwardly and which is spaced apart from said inner tubular segment in radial directions relative to the longitudinal direction to define an upper annular space therebetween;

a tubular runner having a runner surrounding wall that surrounds and that is slidable relative to said stem between upper and lower positions, which are respectively proximate to and distal from said top hub, said runner surrounding wall being configured to be spaced apart from said inner tubular segment in the radial directions so as to define a lower annular space therebetween;

a canopy and rib assembly mounted pivotally on said top hub, and coupled to and moved with said runner between spread-out and collapsed positions, which correspond to the upper and lower positions, respectively;

a tubular spacer slidably sleeved on said inner tubular segment, and configured such that said tubular spacer is insertable into said lower annular space when said runner is displaced to the upper position so as to minimize the dimension of said lower annular space, thereby preventing wobbling movement of said runner relative to said stem, and such that said tubular spacer is movable by said upper annular end to be thereby withdrawn into said upper annular space when said upper annular end is displaced to the retracted position; and a biasing member disposed to bias said tubular spacer into said lower annular space.

2. The umbrella of claim 1, wherein said middle hub portion is configured to cooperate with said upper hub portion to form an annular shoulder which confronts said upper annular end along the longitudinal axis, said biasing member being a coil spring which has two opposite ends abutting against said annular shoulder and said tubular spacer, respectively.

3. The umbrella of claim 1, wherein said runner surrounding wall of said tubular runner has a retaining hole extending therethrough in a radial direction, said top hub having a retaining portion which has a fixed end integrally connected to said middle hub portion, and a retaining end extending downwardly from said fixed end such that said retaining portion acquires a biasing force that urges said retaining end to move radially and outwardly so as to be retained in said retaining hole when said tubular runner is displaced to the upper position.

4. The umbrella of claim 1, further comprising a leaf spring having a biasing force, and disposed in said inner tubular segment, said leaf spring having a retaining end which extends radially and which is movable relative to said inner tubular segment between a retracted position, where said retaining end is depressed radially to retreat into said inner tubular segment against the biasing force when said tubular runner is displaced from the lower position to the upper position, and an extended position, where said retaining end is disposed outwardly of said inner tubular segment to hold said tubular runner in place when said tubular runner is in the upper position.

* * * * *